US006898811B2

(12) United States Patent
Zucker et al.

(10) Patent No.: US 6,898,811 B2
(45) Date of Patent: May 31, 2005

(54) DEVICE FOR EMERGENCY TRANSPORT OF PEDIATRIC PATIENTS

(75) Inventors: Stefanie A. Zucker, Atlanta, GA (US); Suzanne J. Hantke, Loganville, GA (US)

(73) Assignee: Pediatric Medical Devices, Inc., Atlanta, GA (US)

( * ) Notice: Subject to any disclaimer, the term of this patent is extended or adjusted under 35 U.S.C. 154(b) by 0 days.

(21) Appl. No.: 10/238,754

(22) Filed: Sep. 10, 2002

(65) Prior Publication Data

US 2004/0045089 A1 Mar. 11, 2004

(51) Int. Cl.[7] ..... A61G 1/06; A61G 1/044

(52) U.S. Cl. ..... 5/626; 5/621; 5/655; 5/603

(58) Field of Search ..... 5/655, 626, 628, 5/621, 620, 627, 632–634, 603, 94; 24/573.11, 654, 656, 664, 635, 457, 459, 490, DIG. 52, DIG. 53; 128/870, 876; 297/484, 250.1; 296/65.03

(56) References Cited

U.S. PATENT DOCUMENTS

| | | | | | |
|---|---|---|---|---|---|
| 3,476,367 | A | | 11/1969 | Fleissner | |
| 3,577,873 | A | | 5/1971 | Waters | |
| 4,300,782 | A | | 11/1981 | Pioth | |
| 4,667,356 | A | | 5/1987 | Holmquist | |
| 4,670,921 | A | | 6/1987 | Avni et al. | |
| 4,679,260 | A | | 7/1987 | Frettem | |
| D292,612 | S | | 11/1987 | Fitsch | |
| 4,747,172 | A | * | 5/1988 | Hohol et al. | 5/507.1 |
| 4,757,811 | A | | 7/1988 | Clark | |
| 4,836,707 | A | * | 6/1989 | Myers | 24/635 X |
| 4,912,787 | A | | 4/1990 | Bradcovich | |
| 4,921,295 | A | | 5/1990 | Stollenwerk | |
| 4,947,418 | A | | 8/1990 | Barr et al. | |
| 4,977,630 | A | | 12/1990 | Oswalt et al. | |
| 4,979,520 | A | | 12/1990 | Boone, Jr. et al. | |
| 5,014,724 | A | | 5/1991 | Miller | |
| 5,048,136 | A | | 9/1991 | Popitz | |
| 5,127,120 | A | | 7/1992 | Mason | |
| 5,160,185 | A | | 11/1992 | Stang | |
| 5,232,243 | A | * | 8/1993 | Blackburn et al. | 280/732 |
| 5,283,919 | A | | 2/1994 | Grant | |
| 5,387,177 | A | | 2/1995 | Dunn | |
| 5,400,448 | A | | 3/1995 | Zwickey | |
| 5,481,770 | A | | 1/1996 | Ahlsten | |
| 5,496,092 | A | | 3/1996 | Williams et al. | |
| 5,845,351 | A | * | 12/1998 | Berta et al. | 5/626 |
| 5,860,176 | A | | 1/1999 | Norberg | |
| 6,092,525 | A | * | 7/2000 | Church | 128/869 |
| 6,173,462 | B1 | * | 1/2001 | Huang et al. | 5/655 |
| 6,260,220 | B1 | * | 7/2001 | Lamb et al. | 5/621 X |
| 6,345,856 | B1 | * | 2/2002 | Minai | 296/65.03 |
| 6,431,632 | B1 | * | 8/2002 | Kozikowski et al. | 296/65.03 |
| 6,447,060 | B1 | * | 9/2002 | Vila et al. | 297/484 X |
| 6,471,298 | B2 | * | 10/2002 | Carine et al. | 297/484 X |

FOREIGN PATENT DOCUMENTS

| | | | |
|---|---|---|---|
| FR | 2810221 | * | 6/2001 |

* cited by examiner

*Primary Examiner*—Sunil Singh
(74) *Attorney, Agent, or Firm*—Morris, Manning & Martin

(57) ABSTRACT

A device for emergency transport of pediatric patients that safely and efficiently transports a pediatric patient to a medical facility. To confine the patient to the device frame, it includes a child restraint in the form of a restraining belt assembly. The device accommodates children of varying size using the restraining belt assembly. The device also includes a hinge assembly that controls the relative rotation of portions of the frame. A clamp that can releasably attach to an object with a rail, such as a medical transport device is also described. To increase efficiency, the clamp includes a width accommodation feature and a universality feature. These features enable it to secure the device to objects of varying shapes and widths.

26 Claims, 14 Drawing Sheets

DEVICE FOR EMERGENCY TRANSPORT OF PEDIATRIC PATIENTS

BACKGROUND OF THE INVENTION

1. Technical Field

The invention relates in general to the field of emergency transport devices and, more particularly, to a device for the emergency transport of pediatric patients that includes several single-action devices to increase operating efficiency and safety.

2. Description of the Related Art

Medical personnel, such as emergency medical technicians, often transport injured children to and between medical facilities. During transport, they may stabilize injured children using either medical equipment such as EKG's or Intravenous Lines or via hands-on procedures such as cardiopulmonary resuscitation. To avoid further injuring these children, medical personnel must transport them using safe equipment. Consequently, medical personnel need both a safe way to transport children and the flexibility of performing a variety of medical procedures, as needed.

In addition to those needs, medical personnel may also transport individuals ranging in age from a newborn baby to an elderly individual. To accommodate such a diverse group, medical personnel requires the ability to effectively secure both adults and children during transport. It is, however, the ability to safely and effectively transport small children that causes the greatest challenge to the medical professional. For example, a seven-pound, eighteen-inch newborn baby differs significantly from a thirty-pound, forty-inch child. As a result, the transport equipment must accommodate children of varying size. Because this equipment may be used when the lives of these individuals are failing, it should operate efficiently. In addition, space limitations in an ambulance, for example, demand easy storage for this equipment. Therefore, medical personnel need equipment that adjusts to children of varying size, operates efficiently and stores easily.

In response to some of the above-listed needs, medical personnel previously transported children by securing them via various means to a stretcher. One method was accomplished by securing the child directly to the stretcher via use of the stretcher's straps (using the same method they would use to secure an adult). This method uses a typical stretcher that operates efficiently and stores easily. Yet, typical or conventional stretchers do not transport children safely. Usually medical personnel cannot apply enough tension to the straps to safely restrain a child. In addition, the location of the straps may impair medical personnel from performing life-saving procedures. Additionally, since a small child may be still somewhat mobile, they are open to the possibility of incurring additional injuries during the transport. As a consequence, strapping a child directly to a stretcher does not adequately meet the needs of medical personnel.

Similarly, strapping a mother who holds a child to a stretcher does not satisfy the above-mentioned needs. Though this technique uses equipment that operates efficiently and stores easily, it hinders safe transport. If the ambulance stops suddenly and the mother releases the child, the child may "fly forward" in the ambulance causing further injury. If the mother is successful in "holding on" to her child, the child can still be injured, if the mother's weight is thrown forward crushing the child against the seatbelt. In addition, the technique of "holding the child" accommodates children of varying size only to the extent that the mother can hold them. Finally, because the mother's hands cover a portion of the child, she impairs the administration of medical treatment on that area. Thus, strapping a mother to the stretcher with the child also fails to meet the needs of medical personnel.

Further, strapping a typical car seat that holds a child to a stretcher also fails to meet the needs of medical personnel. Though the car seat can adapt to children of varying size, this method impairs safe transport. Since the seat belts in an automobile differ from the straps on a stretcher, and the shape of a car seat differs from the shape of a stretcher, the car seat does not attach securely to the stretcher. This lack of security threatens safety by creating the potential for the car seat to shift or come loose during transport. In addition, the car seat impairs the administration of medical procedures. For example, a paramedic may need to administer cardiopulmonary resuscitation (CPR). Since a child in the car seat cannot lay flat, the paramedic must remove the child from the car seat and begin compressions with the child in his arms. By removing the child from the seat, medical personnel threaten the safety of the child.

In response to the failures of the above-mentioned techniques for transporting injured children, alternative types of pediatric restraining devices have been developed. For example, one device secures to a stretcher using straps. It includes a bendable support mattress secured in a given angular position by leg supports. Medical personnel secure the injured child to the support mattress after this device is attached to the stretcher. While this device provides some improvement, it impairs administration of CPR. In addition, connecting this device to the stretcher using belts demands that medical personnel spend additional time securing the device.

Another pediatric device provides a hard frame with rotating side panels. It attaches to a stretcher with straps and stores in a collapsed position. Though the collapsibility feature enables easy storage, this pediatric device is difficult to attach to the stretcher. Medical personnel sacrifice time in securing the device to the stretcher. In addition, using straps create the potential that the device may move during transport. This potential movement can hinder performance of lifesaving medical procedures. Although this device includes a restraining feature that confines the child to the device, this feature does not adjust to children of varying size.

In sum, previous pediatric emergency transport devices do not transport safely, enable performance of medical procedures, operate efficiently, adapt to children of varying size, and store easily. Therefore, they do not satisfy the needs of medical personnel. When responding to a call, medical personnel should be equipped to adequately provide the medical attention necessary to stabilize and transport any type of patient, including children. They must gather the equipment needed and provide the required medical treatment, including CPR, in a limited amount of time. Thus, there is a need for a device for the emergency transport of pediatric patients that satisfies all of the above-mentioned needs.

SUMMARY OF THE INVENTION

The present invention satisfies the above-mentioned needs in a device for the emergency transport of pediatric patients that clamps to the side rails of the various conventional ambulance stretchers. The device effectively aids in the administration of medical procedures on injured children. To accomplish this, it includes a data center that measures individual information about a child (e.g. weight and heart rate). Using the data center medical personnel can prescribe the appropriate medicine dosage and evaluate the child's stability without additional equipment. The rigidity of the frame also reduces equipment needed for the administration of cardiopulmonary resuscitation (CPR). Instead of using a backboard, medical personnel can administer CPR to a child without removing them from the device. Consequently, the invention reduces the additional equipment needed in administering medical procedures.

A further advantage includes increasing the operating efficiency of medical personnel. The subject invention includes multiple single-action components that reduce the time expended in using the device. The use of a snap-on/quick-release, single-action clamp mechanism, reduces the time needed to secure the device to a stretcher, allowing medical personnel to focus more on the injured child. In addition, the multi-purpose clamp mechanism of the invention enables the device to attach to objects of varying shapes and widths providing increased utility. Therefore, although multiple stretcher devices are currently in use in the marketplace, medical personnel need carry only one pediatric transport device to ensure coverage of all sizes of children. The invention increases efficiency by reducing the equipment needed for transport and the time associated with utilizing that equipment.

This present invention also presents medical personnel with a number of other advantages, including easy storage. The invention collapses enabling it to be stored in an alcove in the ambulance or mounted on the ambulance wall. In addition to easy storage, the invention includes a uniquely designed restraint that reduces the probability of accidental release. The advantages of this restraint lie in its increasing safety by avoiding accidental release even when confining children of various sizes. Many other advantages and useful techniques for the subject invention will become apparent to those skilled in the art.

Generally described, the present invention is a device for the emergency transport of pediatric patients that can be used with a stretcher with a rail to transport a patient. The invention includes a frame adapted to receive a patient and a snap-on/quick release clamp mechanism connected to the frame. The invention's clamp mechanism is adaptable to connect to stretchers of various widths and sizes. The invention may also include a hinge assembly connected to the two frame members. The hinge assembly permits relative rotation of the two frame members. More specifically, the hinge assembly may include an actuation device that selectively adjusts the relative rotation of the frame members.

According to one aspect of the invention, the device includes a restraining belt assembly with a single-action release that connects to both frame members. The restraining belt assembly secures the patient to the stretcher when engaged. More specifically, the restraining belt assembly may include two belts each of which can be released easily and couples to the first frame member at one end and attaches to a common connector at the other end. Each belt may include a length adjustment. The first frame member may also include first and second sets of openings. The belts may be coupled to the first set of openings in response to the patient being placed in the device. The restraining belt assembly, hinge assembly and clamp may also include a release to disengage by a single action.

The clamp mechanism may include a quick-release universal grasping device with a groove that couples to the rail with either a circular or rectangular shape. The clamp mechanism may also include a housing member, a cam, and a locking device. The cam extends close to the grasping device and can connect to the housing member through a spring. When the grasping device contacts the cam, it moves within the housing member. The locking device places the cam in a lock position when engaged. The locking device may include a locking ball detent that can connect to a portion of the cam and a release that can connect to the locking ball detent. When the release is pressed, it disconnects the locking ball detent from the cam, which releases the cam from the lock position. The clamp may adapt to accommodate stretchers of varying width.

The hinge frame may couple to a first part of the first frame member and a first part of the second frame member. The actuation device may include a lever that connects to a second part of the first member and a locking pin that selectively engages the hinge frame in a plurality of positions. A cable connects the locking pin to the lever, such that the locking pin disengages the openings when the lever is actuated.

This present invention may also include a data acquisition device that measures the weight of a person. In addition, the invention may include a handle that connects to a frame member, storage devices that connect to a frame member, and a pad that extends longitudinally over both frame members. The invention may also include second, third and fourth clamps where the second clamp is positioned proximate to the first clamp. The third and fourth clamps diametrically oppose the first and second clamps, respectively. The invention may also include a second hinge assembly that permits relative rotation of a second side of the frame members. The second hinge assembly includes a second hinge frame diametrically opposed from the first hinge frame. A second cable connects the second locking pin to the lever, which enables the second locking pin to engage the second hinge frame in a plurality of positions when the lever is actuated.

The present invention also provides a quick-release universal clamp that couples to objects having either a circular or rectangular shape. The clamp includes a housing member, a grasping device with a groove to receive the object, and a cam surrounding a portion of the grasping device. By contacting the cam when coupled to the object, the grasping device displaces the cam within the housing member. The universal clamp may attach to this present invention.

Figure 1:
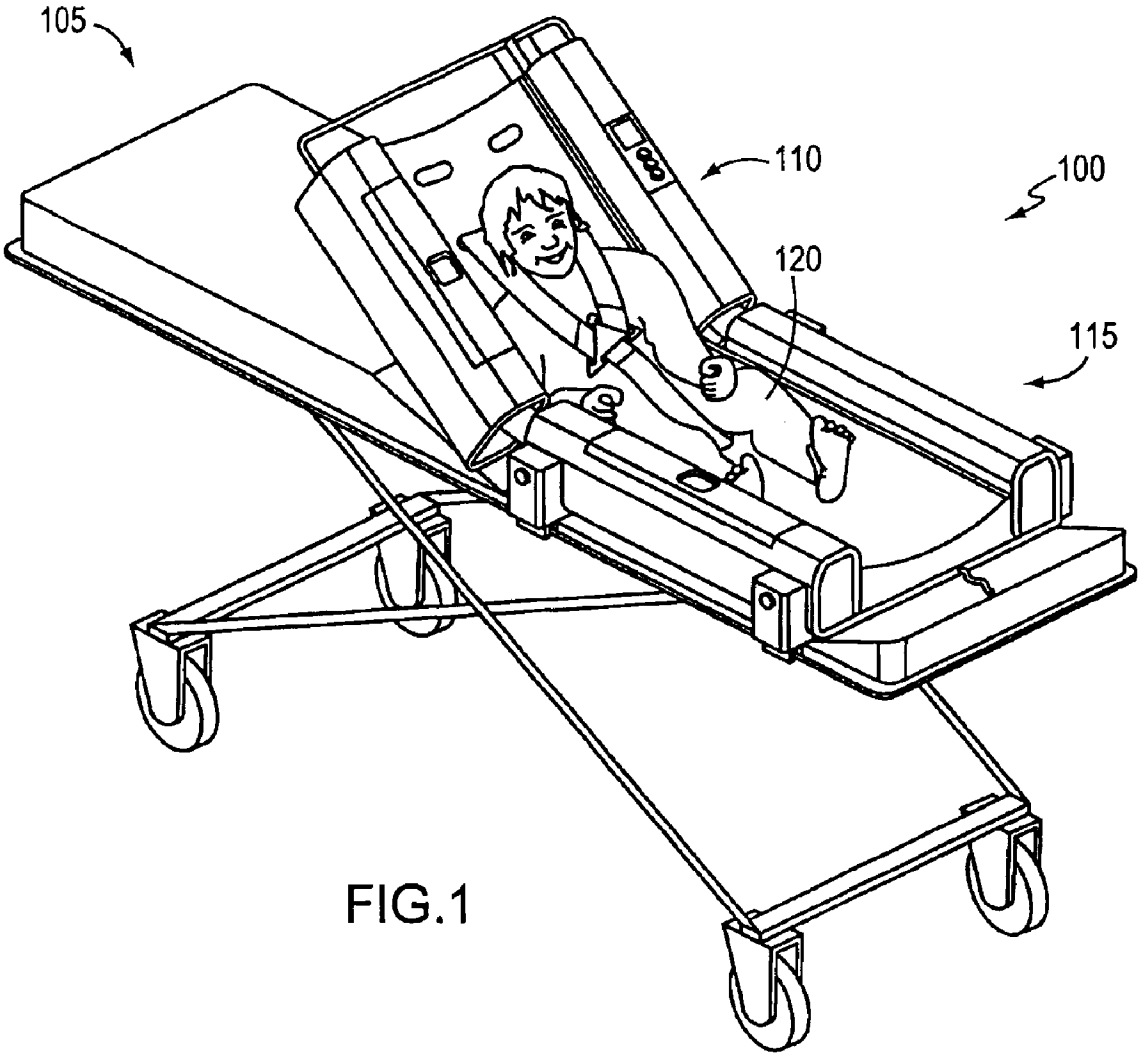
FIG. 1 is a perspective view of a device for emergency transport of pediatric patients according to an exemplary embodiment of the invention, which is shown in greater detail in FIGS. 2A–6.

While the invention is susceptible to various modifications and alternative forms, specific embodiments have been shown by way of example in the drawings and are described in detail. It should be understood, however, that the description herein of specific embodiments is not intended to limit the invention to the particular forms disclosed. On the contrary, the intention is to cover all modifications, equivalents, and alternatives falling within the spirit and scope of the invention as defined by the appended claims.

DETAILED DESCRIPTION OF PREFERRED EMBODIMENTS OF THE INVENTION

Illustrative embodiments of the invention are described below as they might be employed in a device for emergency transport of pediatric patients. In the interest of conciseness, not all features of an actual implementation are described in this specification. It will of course be appreciated that in the development of any actual embodiment, numerous implementation-specific decisions must be made to achieve the developer's specific goals, such as compliance with system-related and business-related constraints. Moreover, it will be appreciated that even if such a development effort might be complex and time-consuming, it would nevertheless be a routine undertaking for one of ordinary skill having the benefit of this disclosure.

1. Overview

The present invention describes a device for emergency transport of pediatric patients that safely and efficiently transports a pediatric patient to a medical facility. The device can attach to a conventional transport device, such as a stretcher. The transport device will typically be positioned in the center of the stretcher to maximize stretcher stability although the invention may be positioned elsewhere on the stretcher.

This present invention includes a frame that can receive the patient. The frame may be divided into sections. For example, an upper section of the frame may support the patient from head to waist. Conversely, a lower section may support the patient from waist to feet. If desired, these sections may consist of metal tubing, medical-grade plastic tubing, or some combination of each.

To confine the patient to the device of the invention, it includes a child restraint in the form of a restraining belt assembly. If the restraining belt assembly is used, it could include two shoulder belts and a leg belt. It may also include a waist belt that connects into the center of the belt assembly. The belts may be formed from nylon, for example. In addition, the two shoulder belts will include a horizontal strap that connects them to each other. This strap may help prevent a child from removing an arm from the shoulder belts. The shoulder belts may connect to the frame through quick-release buckles. The buckles may be formed from stainless steel covered with a plastic-like material. In contrast to the shoulder belts, the leg belt attaches directly to the frame. Though the shoulder belts and leg belt connect to the frame, a metal connector that may be labeled joins the other ends of the three belts together. If desired, the label could be a cartoon children's character.

Further, the invention accommodates children of various sizes using the restraining belt assembly. The upper section of the frame includes several sets of openings associated with ranges of physical dimensions. After placing a child in the device, medical personnel restrain the child by securing the buckles to the set of openings that best accommodate the child's size. To further accommodate the size of the child, medical personnel may vary the length adjustments included on the shoulder and leg belts from the front of the device, without removing the child from the seat or the seat from the stretcher. The length adjustments themselves may be formed from metal covered in plastic material.

Medical personnel secure a child to the invention by connecting the buckles to a set of frame openings. Specifically, they push the buckles toward the openings. Each opening contains an anchor positioned in the center that may be formed from stainless steel. As the buckle approaches the anchor, it contacts a locking plate within the buckle that may also be formed from stainless steel. The locking plate rotates slightly and then traps the anchor. This action secures the restraining belt assembly to the frame. Hence, it secures the child to the device of the present invention. Securing the buckles to the frame above the child's shoulders reduces the chance of accidental release during transport.

Conversely, pressing a release button and pulling the buckles away releases a child from the device. Specifically, pressing the release button rotates the locking plate. As the buckle is pulled away, the anchor clears the locking plate and removes the restraint. That single action of pressing the button disengages the restraining belt assembly. Similarly, the single action of attaching the buckle engages the restraining belt assembly. Hence, the restraining belt assembly is a single action device.

In addition to the restraining belt assembly, the invention includes a hinge assembly. It controls the rotation of the upper frame section relative to the lower frame section. The hinge assembly includes a hinge frame and an actuation device. The hinge frame connects the hinge assembly to the frame sections and may be formed from stainless steel. The actuation device controls the movement of the upper section relative to the lower section and includes a cable, lever, and locking pin that selectively locks within the hinge frame. The cable and the lever may be formed from braided steel and stainless steel, respectively. Alternatively, the actuation device may include a pressure clamp and ball—ratchet instead of the locking pin.

To operate the hinge assembly, medical personnel squeeze the lever. This action unlocks the locking pin from the hinge frame. With the lever still squeezed, they may manually rotate the upper section to a desired angular position. Releasing the lever selectively secures the locking pin in the hinge frame and retains the upper section in the desired position. The single action of releasing the lever engages the hinge assembly. In addition, the single action of squeezing the lever disengages the hinge assembly. Hence, the hinge assembly is a single action device.

The invention also includes a clamp mechanism with at least one quick-release clamp that attaches to a rail of an object such as a stretcher. Numerous clamps also may be used. The clamp includes a housing member, grasping device, cam and locking device. The grasping device connects the stretcher by receiving its rail. Alternatively, the grasping device may connect the invention to a wall of an ambulance or another object. The locking device secures the rail within the grasping device through interaction with the cam. The locking device may include a locking ball detent, pressure clamp, or similar securing device. The clamp components may be formed from a type of steel, such as stainless steel.

To operate the clamp, medical personnel push the device with the clamp extended towards the stretcher rail. As the rail contacts the grasping device, it pivots and contacts the cam. In response, the cam moves upward in the housing member and creates a spring force. Once the grasping device surrounds the rail, the spring force moves the cam downward in the housing member. Medical personnel then pull up slightly on the device. As they pull up, the cam floats further downward in the housing member. As the cam approaches the locking device, it engages and secures the cam in a locked position. The securing of the cam results in securing the grasping device in a locked position, which secures the clamp to the stretcher.

To release the clamp, medical personnel press a release included within the locking device. This action disengages the locking device from securing the cam. Then, medical personnel pull the device away from the rail of the stretcher. As the rail moves within the grasping device, it contacts the cam. The cam moves upward in the housing member creating a spring force. Once the rail clears the grasping device, the cam moves downward in the housing member as the spring force releases. The cam returns to its original position.

To increase efficiency, the clamp includes a width accommodation feature and universality feature. Medical personnel may utilize the width accommodation feature by displacing the clamp relative to the frame. For example, medical personnel may adjust the clamp for narrower stretchers by pushing the clamp further inside the frame. The universality feature enables the clamp to attach to rails of various shapes. Because the grasping device includes a universal groove, medical personnel attach the device to stretchers with circular rails in the same manner by which they attach them to stretchers with rectangular rails. Thus no additional equipment or training is needed. Alternatively, the universality feature may include other rail shapes, such as triangular.

2. Description of the Drawings

Referring now to the drawings, in which like numerals indicate like elements throughout several figures, FIG. 1 illustrates a perspective view of a device 100 for emergency transport of pediatric patients according to an embodiment of the invention. The device 100 for emergency transport of pediatric patients provides safe transport of a youth and may attach to a transport device 105, such as a stretcher. The device 100 includes a frame divided into a pair of sections 110, 115. The contours of these frame sections form a receptacle for a child 120. The sections 110, 115 may support the upper and lower portions of the child 120, respectively.

Figure 2A:
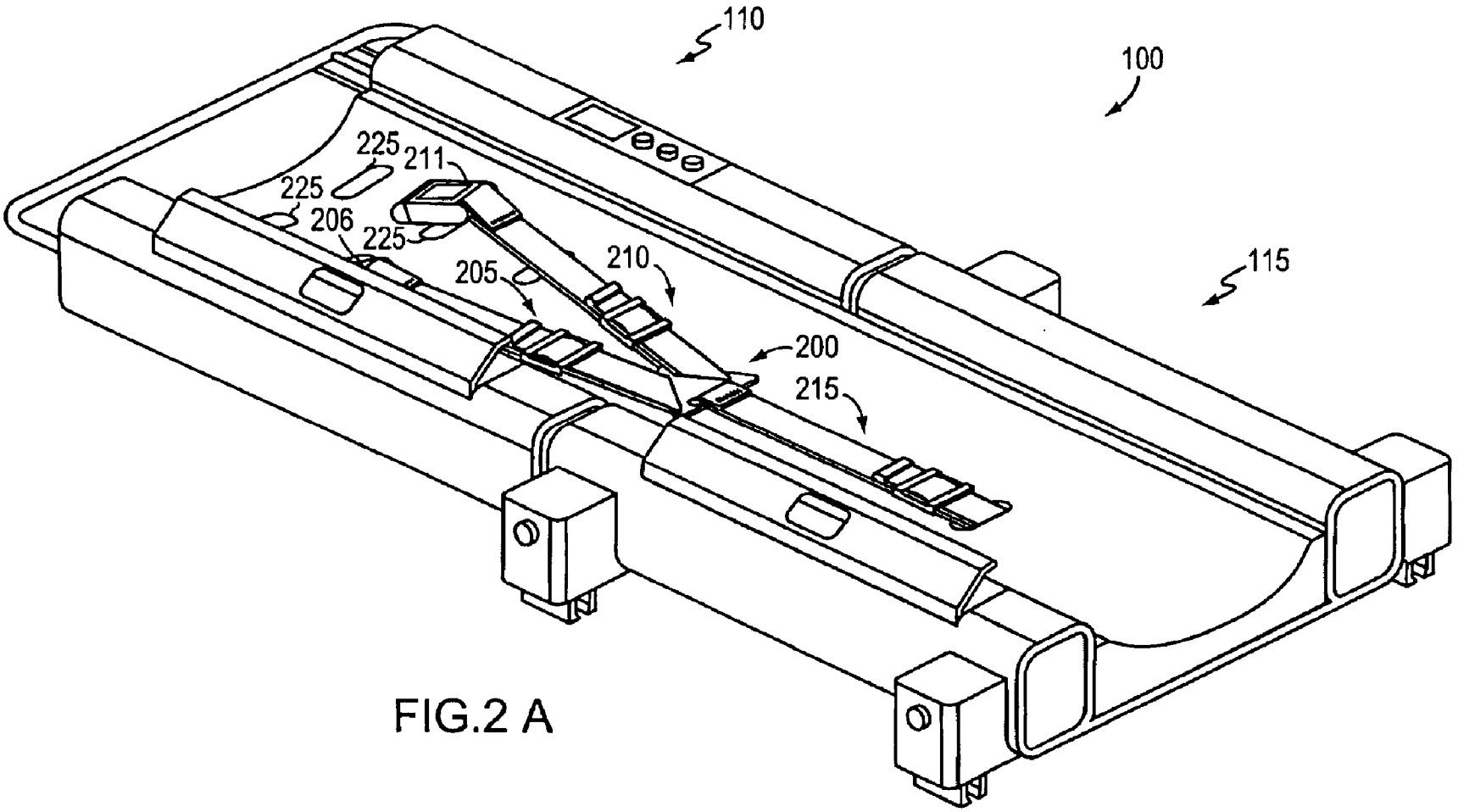
FIG. 2A is a perspective view illustrating the integration of a restraining belt assembly within the pediatric emergency transport system of FIG. 1.

FIG. 2A is a perspective view illustrating the integration of a restraining belt assembly 200 that releasably secures a child to the device 100. The restraining belt assembly 200 includes the belts 205, 210, 215 and the buckles 206, 211. It accommodates children over a wide range of sizes by using a multi-level adjustment feature. The section 110 includes several sets of orifices 225 (of which three have been shown) in which the buckles 206, 211 may be inserted to connect the buckles to the device. Associated with each set of orifices 225 is a range of physical dimensions for a child. For example, medical personnel may use one set of orifices 225 for children ranging from ten to twenty inches tall. By connecting the buckles 206, 211 to different sets of orifices 225, they adjust the device 100 based on the child's size.

Figure 2B:
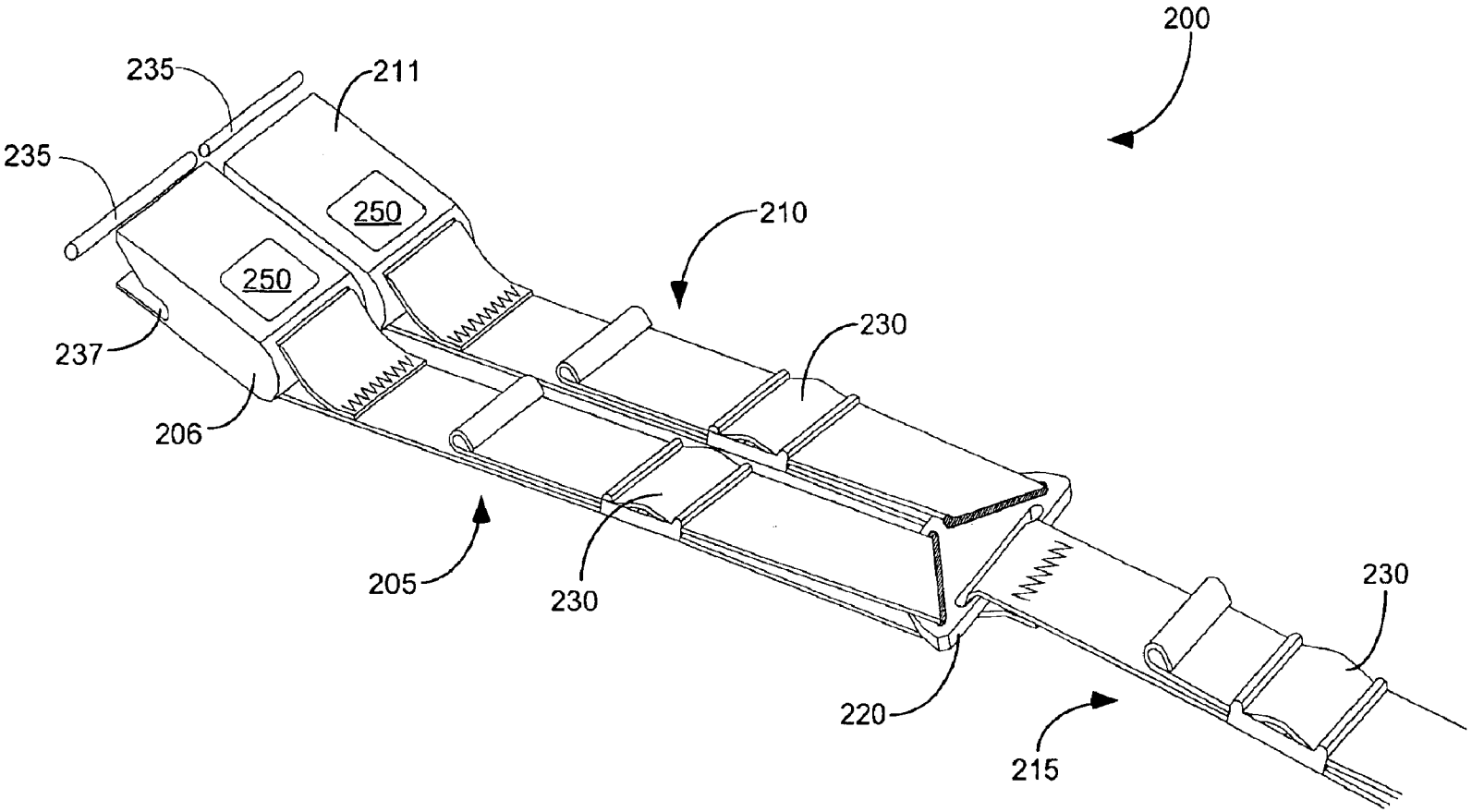
FIG. 2B is a perspective view illustrating the restraining belt assembly.

FIG. 2B is a detailed perspective view of the restraining belt assembly 200 that illustrates another length adjustment feature of the device 100. Medical personnel may further accommodate the size of a child using a length adjustment 230. The belts 205, 210, 215 include the length adjustment 230 that varies the length of the corresponding belt. For example, a child may have a small upper body and long legs. In response, medical personnel may shorten the belts 205, 210 and lengthen the belt 215. Using the selection of orifices 225 and the length adjustment 230 medical personnel can effectively confine children in the device 100. Moreover, these features enable size accommodation without removing the child from the device 100.

Figure 2C:
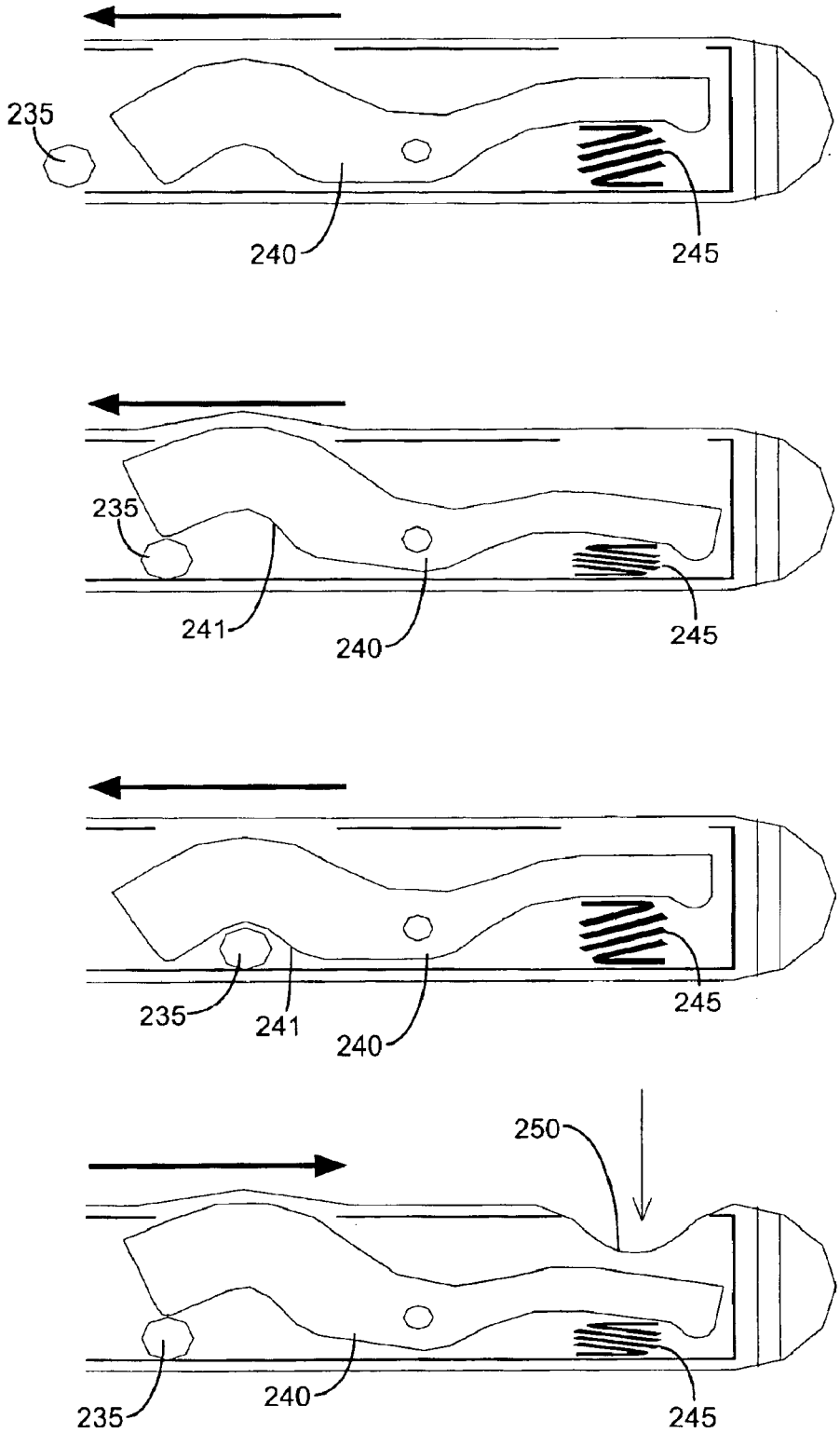
FIG. 2C is a side view of a buckle used with restraining belt assembly of FIG. 2A.

FIGS. 2A, 2B and 2C illustrate the operation of the buckles 206, 211 that secure a child 120 to the device 100. Medical personnel move the buckles 206, 211 toward a plurality of belt anchors 235 centered in the orifices 225. Because the buckles 206, 211 contact the anchors 235 and operate identically, the operation of buckle 206 is described for simplicity. As the buckle 206 encounters the anchor 235, a buckle guide 237 directs the anchor 235 towards a locking plate 240 (FIG. 2C). The locking plate 240 pivots in response to contact from the anchor 235. The pivoting of the locking plate 240 creates a spring force by compressing a spring 245. As the anchor 235 contacts a bottom side 241 of the locking plate 240, the spring force releases. As it releases, the locking plate 240 pivots back to its original position. This sequence of actions secures, the restraining belt assembly 200 to the section 110. Consequently, the child is secured to the device 100 for emergency transport of pediatric patients.

To remove a child from the device 100, medical personnel press a release button 250. This creates a spring force by compressing the spring 245 and rotates the locking plate 240. While holding the release button 250, they may pull the buckle 206 away from the anchor 235. Because the locking plate 240 has rotated, the anchor 235 can clear the buckle 206. Thus, pulling away releases the anchor 235 from the buckle 206 and removes the restraint from the child. Since the restraint is detached, medical personnel may remove the child causing the belts 205, 210, 215 to fall aside.

Medical personnel can either secure or release the restraining belt assembly 200 with a single action namely pressing the buckle 206 into engagement with respective actions. The single action of connecting the buckle secures a child and engages the restraining belt assembly 200. The single action of pressing the release button 250 releases a child and is disengages the restraining belt assembly 200. Because each buckle of the restraining belt assembly 200 engages or disengages with a single action, medical personnel save time. Hence, they may use the device 100 for emergency transport of pediatric patients with greater efficiency.

Figure 3A:
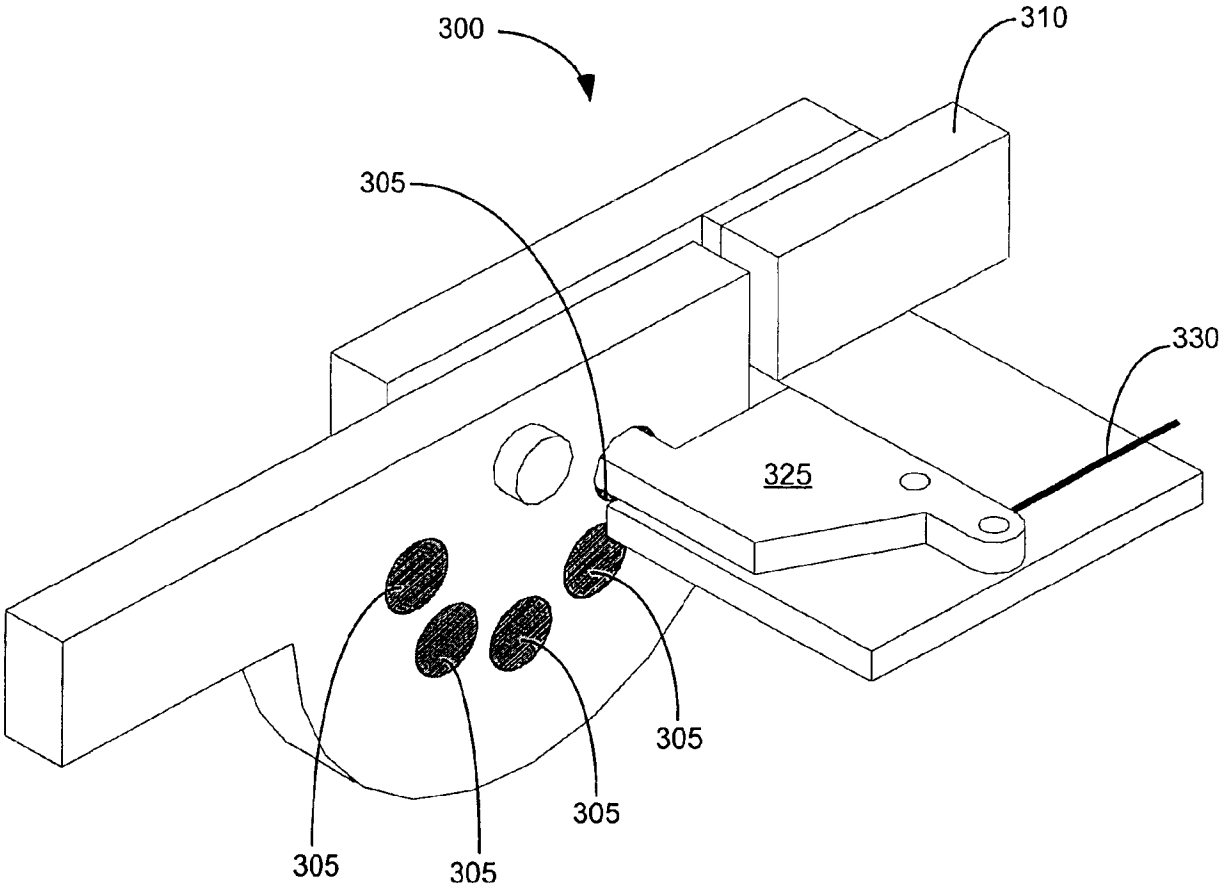
FIG. 3A is a perspective view illustrating a portion of the hinge assembly.

FIG. 3A illustrates a portion of the hinge assembly included in the device 100. This hinge assembly controls the rotation of the section 110 relative to the section 115 and includes a hinge frame 300 and an actuation device. The hinge frame 300 connects to the section 110 by a piece 310 and connects to the section 115 in a similar manner (not shown). The actuation device controls the relative movement between the sections 110, 115 and includes a locking pin 325 and a cable 330. The locking pin 325 selectively engages one of a plurality of orifices 305 in the hinge frame 300 as the cable 330 moves. The actuation device also includes a lever 335 connected to the cable 330 as shown in FIG. 3B.

Figure 3B:
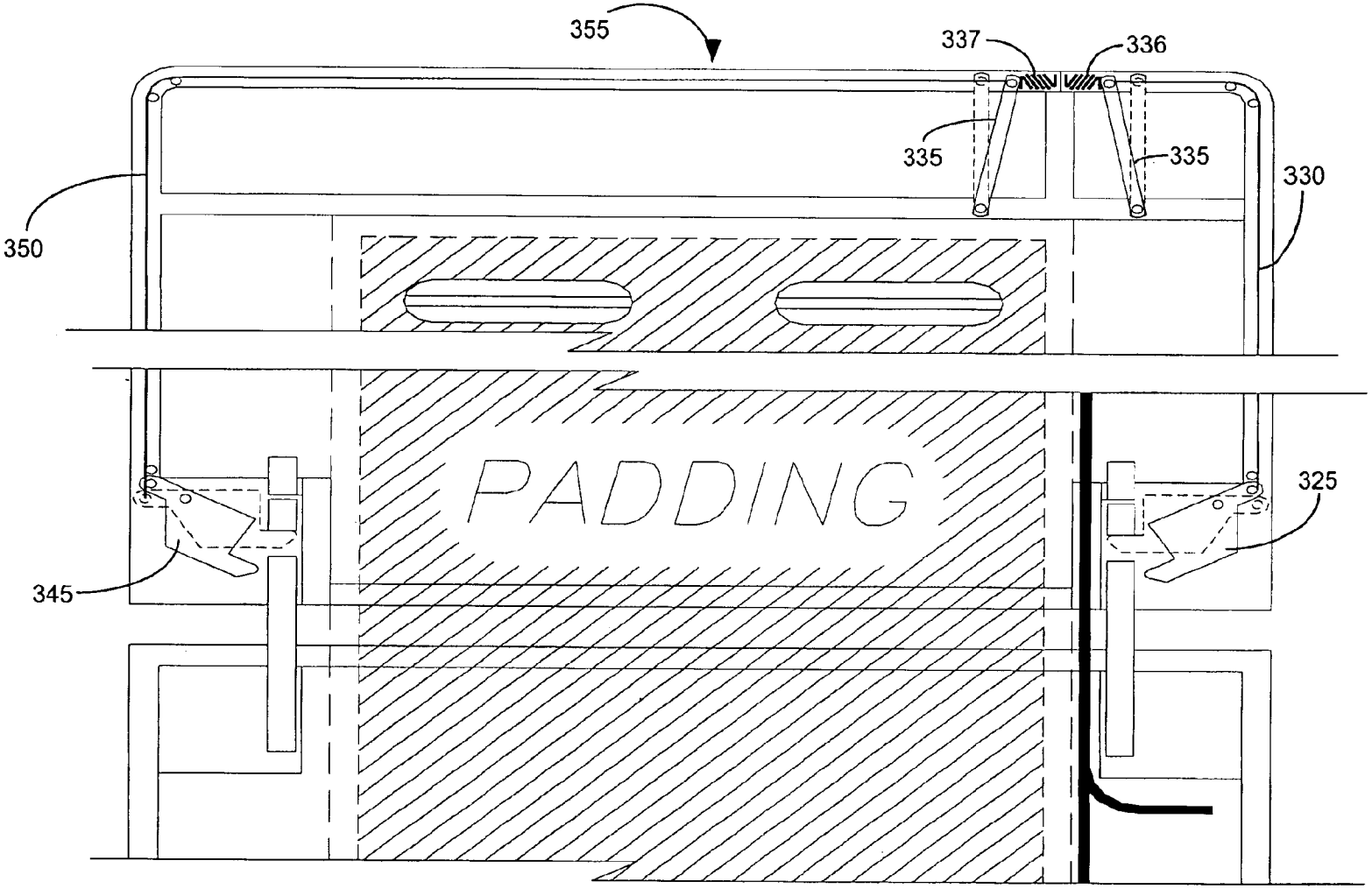
FIG. 3B is a planar view illustrating an actuation device for use with the hinge assembly of FIG. 3A.

FIG. 3B illustrates the operation of the hinge assembly as medical personnel squeeze the lever 335. This action compresses the springs 336, 337 and separates the locking pin 325 from an orifice 305 in the hinge frame 300. While squeezing the lever 335, they may manually rotate the section 110 into a desired position. When desired, a handle 355 aids movement of the section 110 as medical personnel clasp the lever 335. Once the desired position is reached, medical personnel release the lever 335. The release of the springs 336, 337 expands the lever 335. As a result, the locking pin 325 selectively locks in the closest orifice 305 and secures the section 110 in approximately the desired position. It follows that the positions of the orifices 305 dictate the relative angular displacement of the section 110 from the section 115. The orifices 305 may correspond to angular displacements of 0°, 45°, 90°, 135° and 180°. Alternatively, the orifices 305 may correspond to displacements of 0°, 10°, 20°, 30°, and 40°. Hence, both the angular displacements and number of orifices 305 may vary as desired.

Practical implementation of this present invention may demand that it include a second hinge assembly also shown in FIG. 3B. The second hinge assembly could rotate the other side of the section 110. It could include a hinge frame 340, a locking pin 345, a cable 350 and may be used with the lever 335. The hinge frame 340, locking pin 345, and cable 350 function identically to the hinge frame 300, locking pin 325, and cable 330. Because the two hinge assemblies function identically, previous references identify the hinge assembly that includes the frame 300, for simplicity. In addition, both hinge assemblies engage as a single unit with the single action of squeezing the lever 335 and disengages with the single action of releasing the lever 335. Using the hinge assembly reduces the time medical personnel spend positioning the device 100 for emergency transport of pediatric patients. This leads to more efficient operation.

Figure 3C:
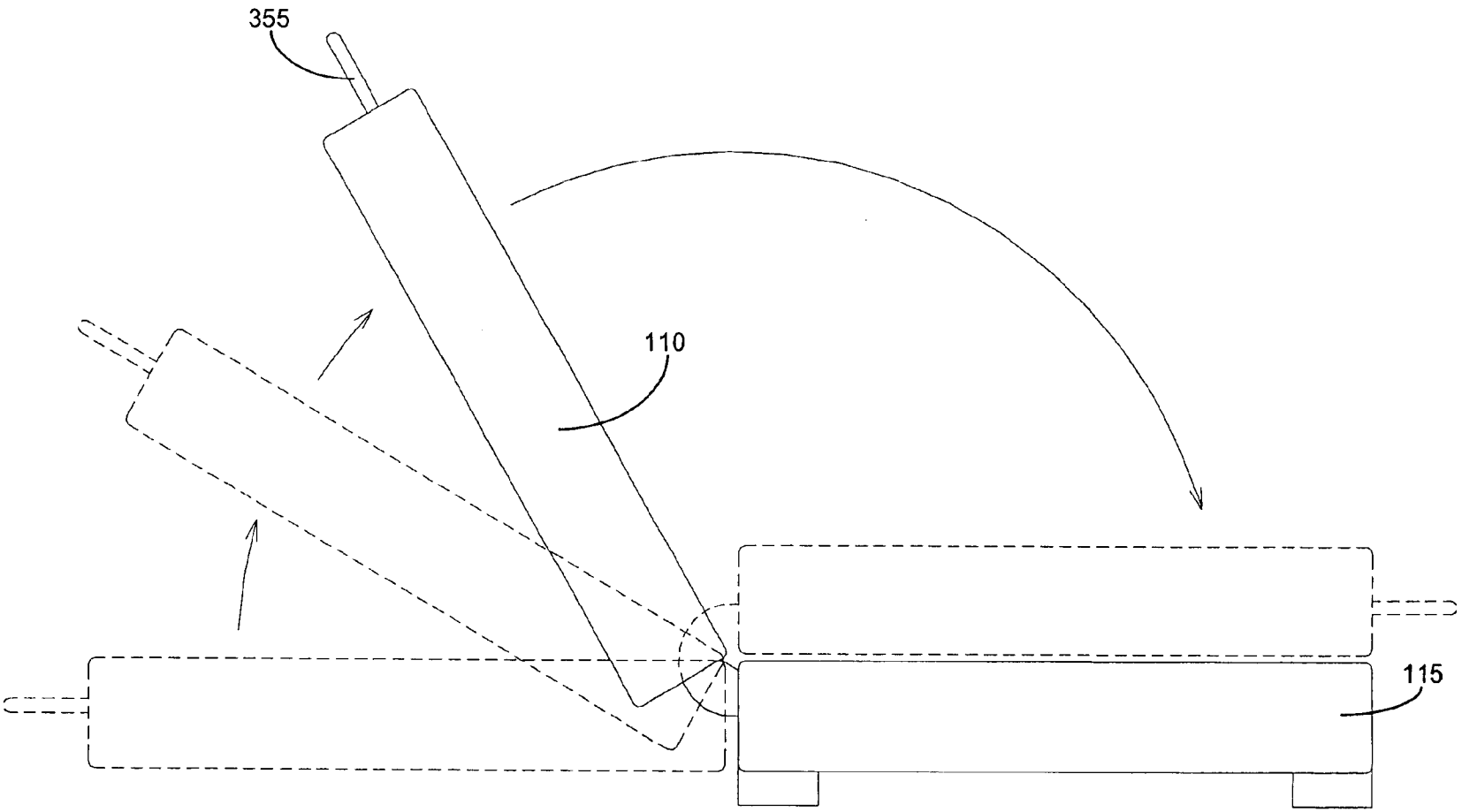
FIG. 3C is a side view illustrating collapsibility feature of the device of FIG. 1.
Figure 3D:
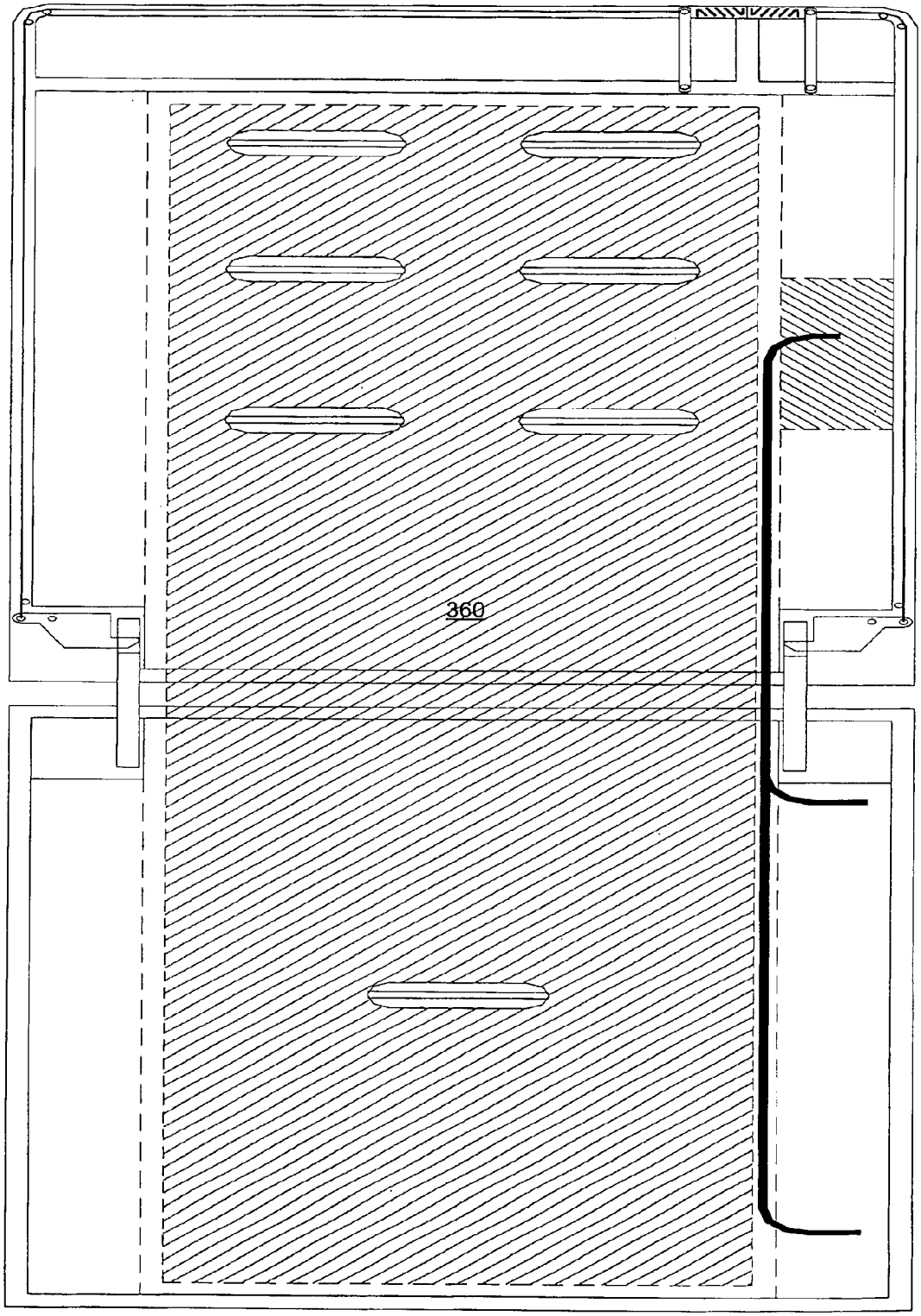
FIG. 3D is a planar view illustrating a pad.

In addition to controlling the rotation of the section 110, select angular displacements may serve particular purposes. FIG. 3C is a side view illustrating the collapsibility feature of the device 100. For an angular displacement of 0°, the section 110 folds on top of the section 115 enabling the device 100 for emergency transport of pediatric patients to be stored easily in a compact environment such as an ambulance. For an angular displacement of 180° of the section 110, the device 100 lies parallel to a stretcher. In this position, medical personnel can administer cardiopulmonary resuscitation (CPR), without removing the child from the restraining device 100. FIG. 3D illustrates a pad 360 that would not impede the administration of CPR if used with the device 100. The pad 360 may have a corresponding cover that protects this pad from fluids and bacteria transmission. Alternatively, a removable pad (not shown) may be used in conjunction with the pad 360 to provide additional comfort.

Figure 4A:
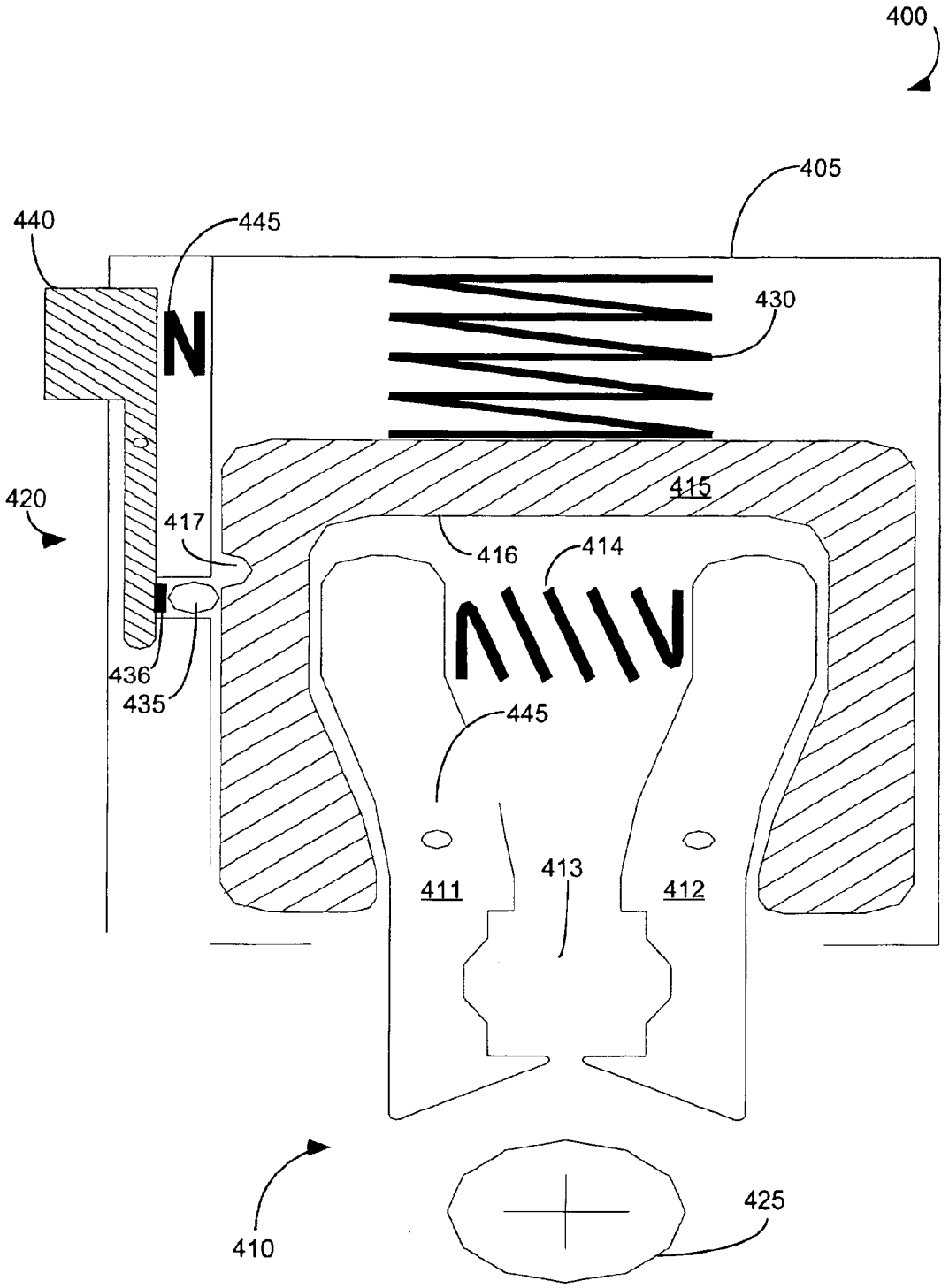
FIG. 4A is a planar view illustrating a clamp.

FIG. 4A illustrates a clamp 400 included in the device 100 for emergency transport of pediatric patients. The clamp releasably couples a stretcher to the device 100. The clamp 400 includes a housing member 405, grasping device 410, cam 415, and locking device 420. The grasping device 410 includes fingers 411, 412, groove 413, and spring 414. The locking device 420 includes a locking ball 435, locking ball spring 436, and release 440. The locking ball 435 and locking ball spring 436 form a locking ball detent. The cam 415 surrounds a substantial portion of the grasping device 410. The shape of the inner surface 416 of the cam 415 allows it to be positioned in close proximity to the fingers 411, 412. The locking ball 435 couples to the cam 415 by a groove 417. The cam 415 connects to the housing member 405 through a spring 430.

Figure 4B:
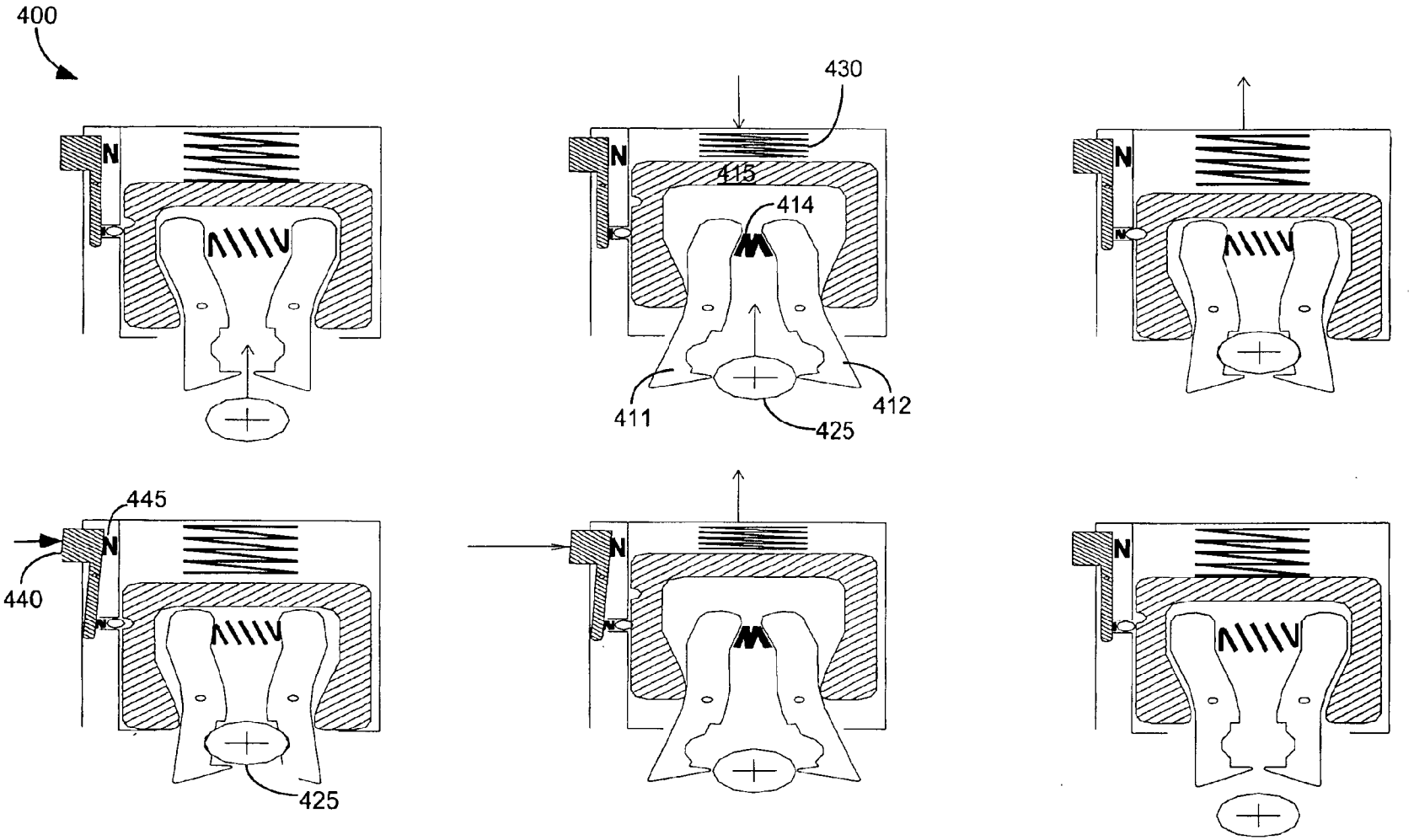
FIG. 4B is a planar view illustrating the operation of the clamp for one type of rail.

FIGS. 4A and 4B together illustrate the operation of the clamp 400. To secure the clamp 400 to a rail 425, an operator may perform the single action of pushing the device 100 with the clamp 400 extended towards the rail 425. As the fingers 411, 412 contact the rail 425, they pivot moving the rail 425 toward the groove 413. As the fingers 411, 412 pivot, they compress the spring 414 and contact the cam 415. In response, the cam 415 moves upward within the housing member 405 and compresses the spring 430. As the rail 425 rests within the groove 413, the spring 414 releases and rotates fingers 411, 412. The spring 430 also releases and moves the cam 415 downward in the housing member 405.

Though the clamp 400 is coupled to the rail, medical personnel may lock it by pulling upward on the device 100 for emergency transport of pediatric patients. This moves the cam 415 further downward in the housing member 405. As the groove 417 of the cam 415 reaches a position adjacent to the locking ball 435, the force from locking spring 436 thrusts the locking ball 435 into the groove 417. Thus, the locking ball 435 secures the cam 415 and the clamp 400 in a locked position. The locked position reduces the probability that the device 100 accidentally releases the rail 425.

After locking the clamp 400, medical personnel may release the rail 425 using the single action of pressing the release 440. Medical personnel press the release 440, that releases the cam 415 as the locking ball 435 rolls toward the now displaced locking ball spring 436. As the device 100 is pulled away from the rail 425, the rotation of the fingers 411, 412 forces the cam 415 to compress the spring 430. Once the rail 425 clears the fingers 411, 412, the force from spring 430 moves the cam 415 back down to its original position.

The locking feature of the clamp 400 may securely attach this present invention 100 to a stretcher 105. Alternatively, the clamp 400 may aid in storing the present invention 100. When used for storage, the device 100 for emergency transport of pediatric patients may secure to a rail on the wall of an ambulance, for example using the clamp 400. In addition, the clamp 400 may also efficiently secure a device to objects of various shapes independent of the device 100.

Figure 4C:
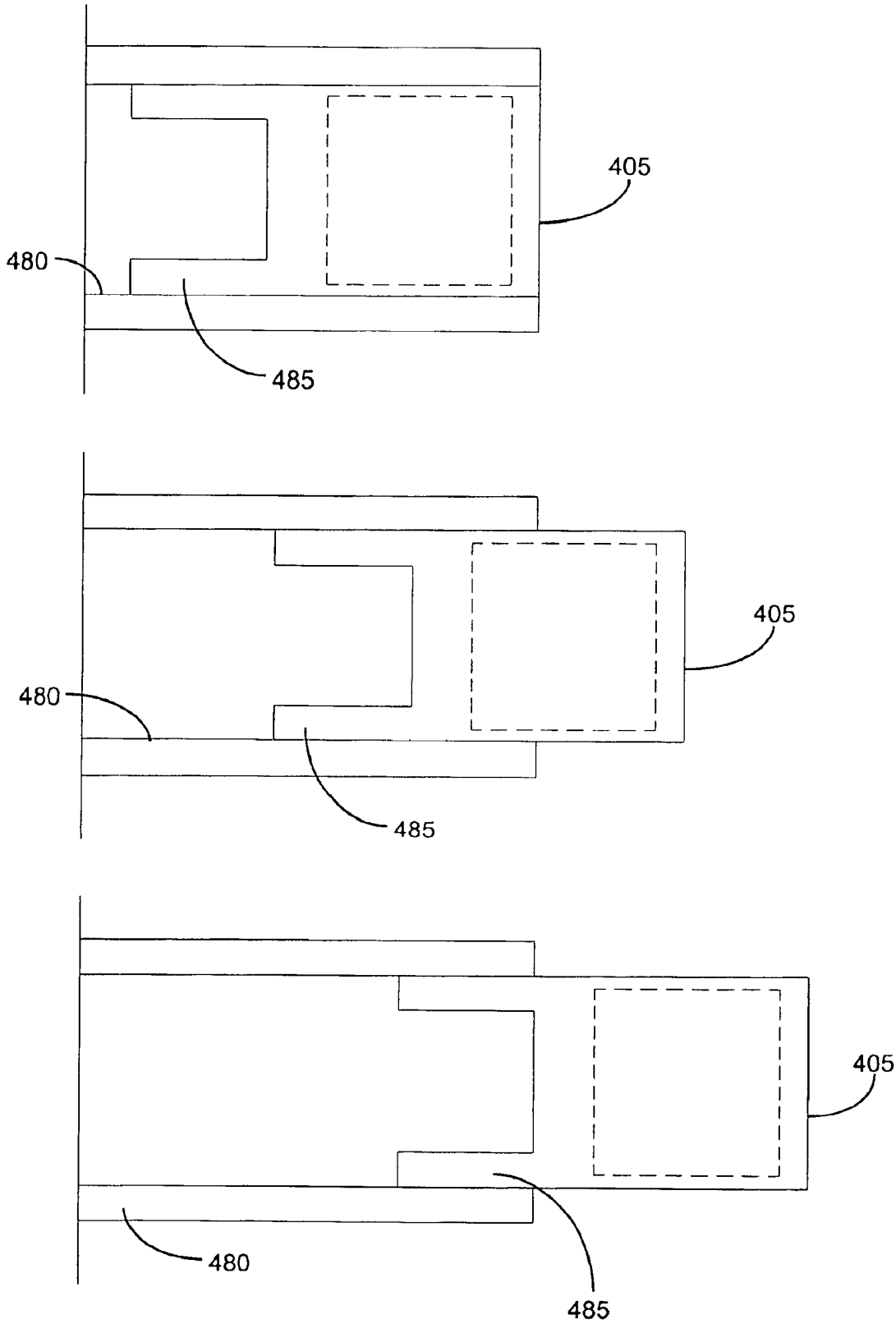
FIG. 4C is a planar view illustrating the width adjustment feature of the clamp of FIG. 4A.

FIG. 4C illustrates the width adjustment feature of the clamp 400. The section 115 includes a frame guide 480 in sliding relation with a clamp guide 485. The clamp guide 485 attaches to the housing member 405. If medical personnel desire connection of the device for emergency transport of pediatric patients 100 to a stretcher of a different size, they vary the displacement between the clamp guide 485 and the frame guide 480. For example, a narrower stretcher may have rails that are closer together. In response, medical personnel push the clamp 400 further into the section 115. This causes the clamp guide 485 to slide along the frame guide 480 until the desired position is reached. A securing device placed between the frame guide 480 and the clamp guide 485 may lock the frame guide and clamp guide at pre-selected rail widths. The securing device may be a locking ball detent, locking pin, or an allen wrench with corresponding set screw.

Figure 4D:
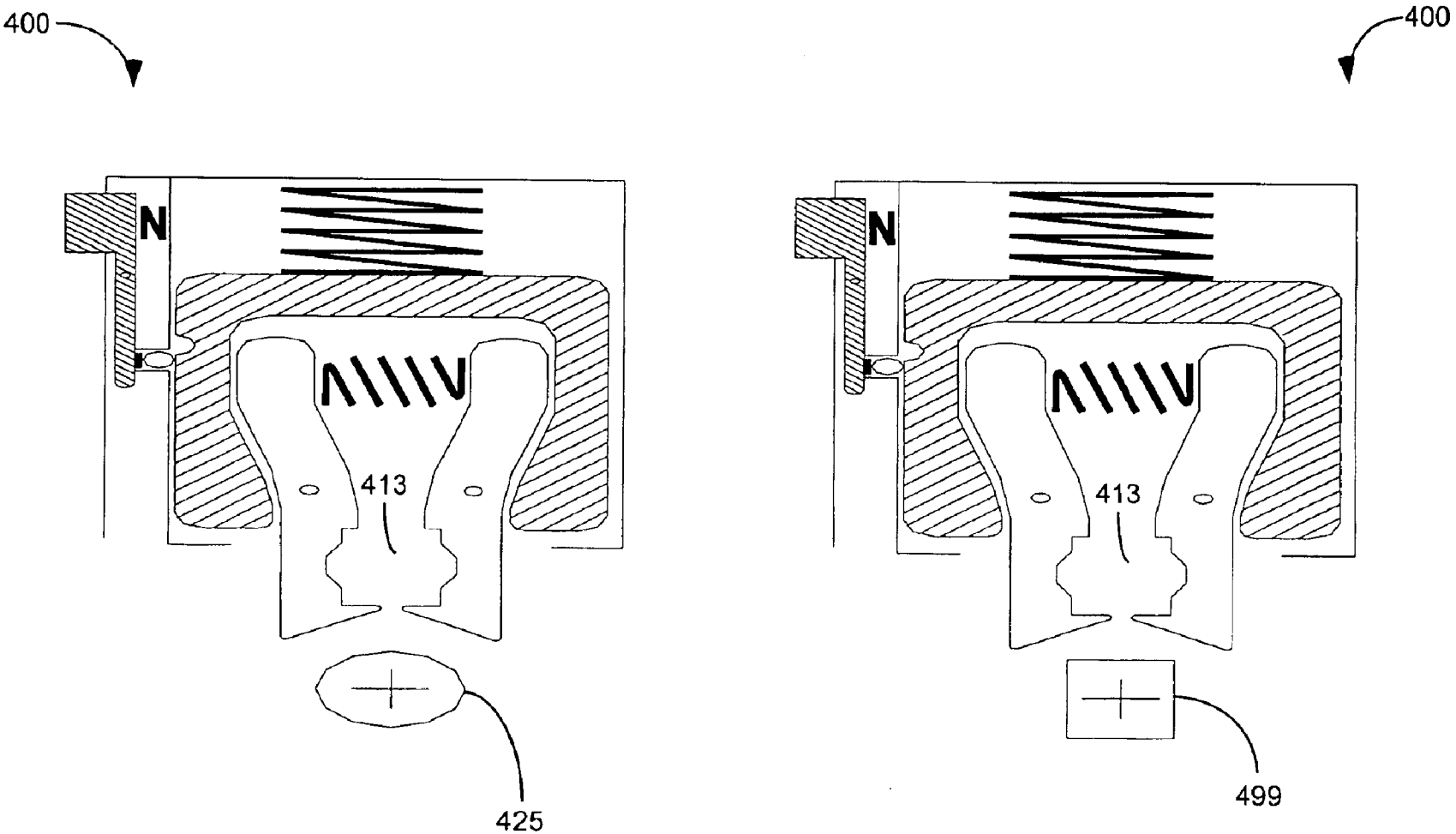
FIG. 4D is a planar view illustrating the versatility of the clamp mechanism to accommodate two types of stretcher railings.

FIG. 4D illustrates the adaptability of the clamp 400 to a circular rail 425 and a rectangular rail 499. Medical personnel may utilize this feature by using this present invention 100 with a stretcher. For example, some medical personnel may work for an ambulance company that utilizes two types of stretchers—one with a circular rail and one with a rectangular rail. In an emergency that requires a child transport, the medical personnel in an ambulance with a circular rail 425 would not spend additional time returning to the station before responding to a call in order to pick up a stretcher with a rectangular rail 499 to accommodate the device for emergency transport of pediatric patients. The reverse situation is also the same. The device 100 adapts to both types of rails. Moreover, the clamp 400 may adapt to other rail shapes, such as triangular by appropriately modifying the groove 413. Hence, the universal adaptability of the clamp increases the operating ability of the device 100.

Figure 5:
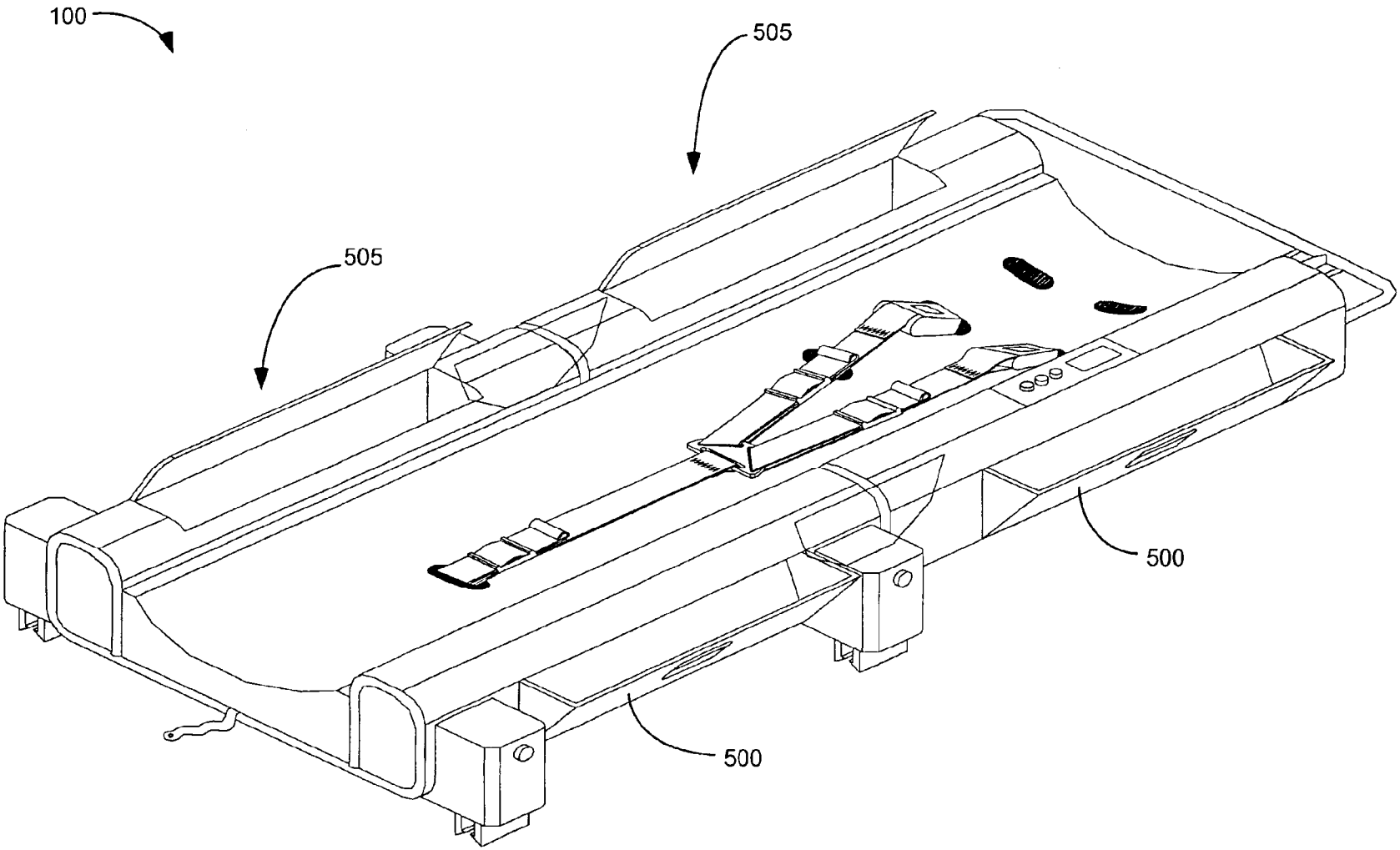
FIG. 5 is a perspective view illustrating storage devices.

As illustrated in FIG. 5, the present invention 100 may also include a plurality of storage devices 500, 505. The position of the storage devices 500 corresponds to the side of a stretcher that secures to the ambulance. For example, a stretcher that secures to the right side of an ambulance could also include storage devices 500 on the left side. The storage devices 505 may be on either side of the restraining device 100. The storage devices 500, 505 may contain devices specifically designed to treat pediatric patients, such as pediatric needles or equipment needed to intubate a child.

Figure 6:
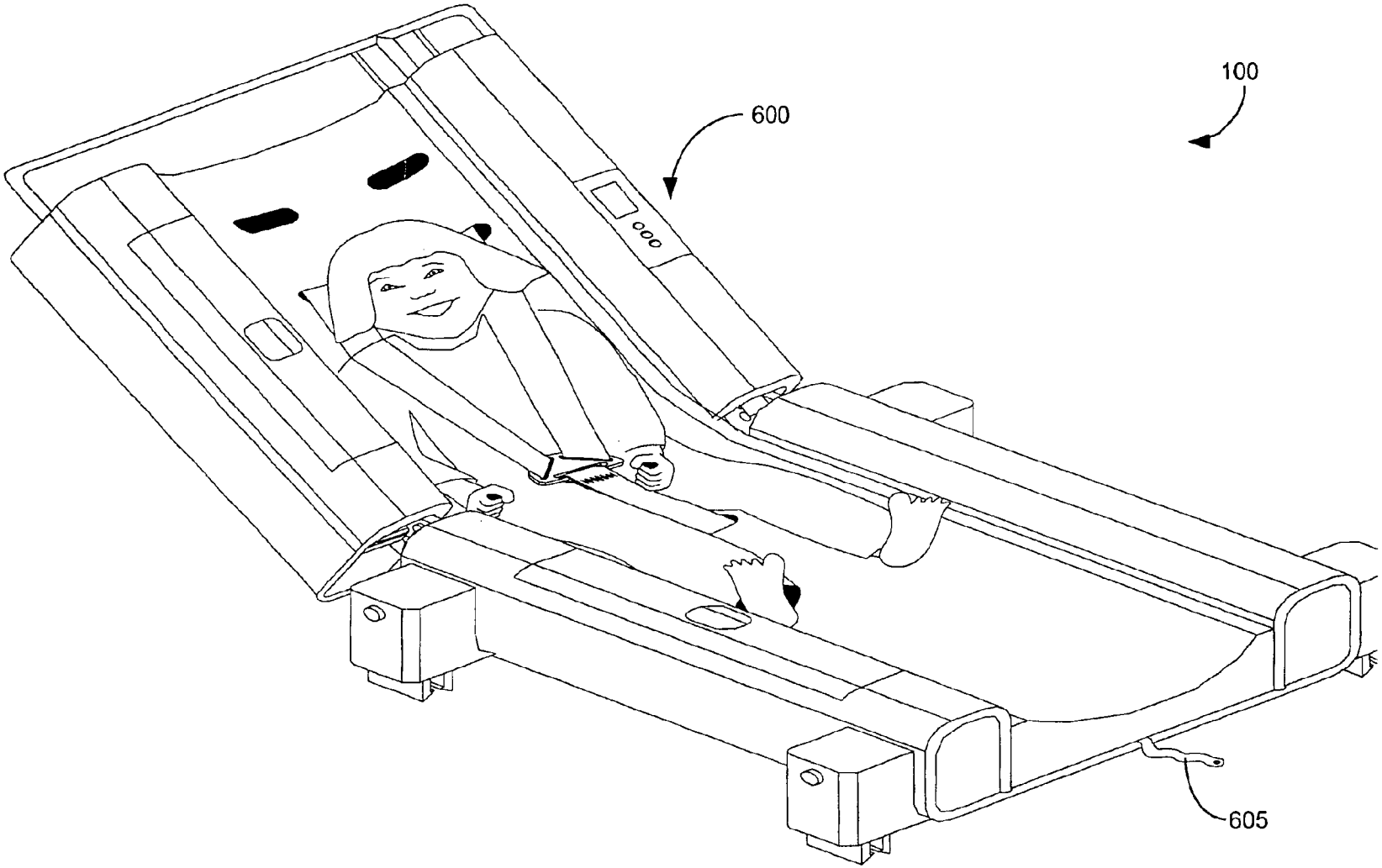
FIG. 6 is a perspective view illustrating a data acquisition device and a closure strap.

FIG. 6 illustrates additional features of the device for emergency transport of pediatric patients 100. The device 100 may include a data acquisition device (DAD) 600 as illustrated in FIG. 6. It may be a commercially available device modified to measure an individual's vital signs or weight. The wiring for the DAD 600 may couple to the clamp 400 through a device that converts stress measurements into electrical signals. For example, this device would convert the stress applied to the clamp due to the weight of the child to a number displayed on the DAD 600. Medical personnel could read this number. By knowing the patient's vital signs or weight as measured by the DAD 600, medical personnel may more effectively treat the patient, administering more accurate doses of medication, etc.

Also illustrated in FIG. 6, medical personnel may use a closure strap 605 when the device 100 is collapsed as previously described in relation to FIG. 3C. As mentioned above, the hinge assembly, more specifically the locking pin 325, secures the restraining device in the collapsed position. Yet, medical personnel may visibly indicate the collapsed position using the strap 605. The strap 605 may consist of leather and attach to the section 115, 110 through stitching and a snap, respectively.

This present invention 100 provides a more effective and safer device to transport and treat children than the conventional devices currently available. It operates efficiently using multiple single-action components. This present invention 100 also adapts to stretchers of various rail types. The invention's design aides the administration of various types of medical procedures, including CPR, with a child in the device. It adapts to children of various size using the restraining belt assembly 200. As a whole, medical personnel using the device for emergency transport of pediatric patients 100 could operate more efficiently and focus primarily on treatment instead of transport.

It will be appreciated by those of ordinary skill in the art having the benefit of this disclosure that numerous variations from the foregoing illustration will be possible without departing from the inventive concept described therein. Accordingly, it is the claims set forth below, and not merely the foregoing illustration, which are intended to define the exclusive rights of the invention.

The invention claimed is:

1. A pediatric emergency transport device adapted for rapid mounting to and demounting from a conventional stretcher, comprising:

a frame having a receiving surface for receiving a pediatric patient thereupon;

a clamp assembly attached to the frame and comprising pivotal, spring-loaded fingers adapted to snap onto opposed rails of the conventional stretcher; and an adjustable restraint assembly coupled to the frame, the restraint assembly comprising a buckle releasably attachable to any one of a plurality of belt anchors mounted to the frame, the restraint assembly accessible and adjustable entirely from the receiving surface of the frame.

2. The pediatric emergency transport device of claim 1, wherein the frame comprises a lower torso portion and an upper torso portion pivotally hinged thereto, and wherein the clamp assembly is attached to the lower torso portion of the frame.

3. The pediatric emergency transport device of claim 1, wherein the belt anchors are mounted to the frame for selective engagement with the buckle above the shoulder of the pediatric patient and wherein the belt anchors are positioned within the frame to accommodate a plurality of pediatric patient heights.

4. The pediatric emergency transport device of claim 1, further comprising a data acquisition device coupled to the frame for measuring the weight of the pediatric patient.

5. A pediatric emergency transport device adapted for rapid mounting to and demounting from a conventional stretcher, comprising:

a frame comprising a receiving surface for receiving a pediatric patient;

clamps mounted on each side of the frame and adapted to snap into engagement with rails of the conventional stretcher responsively to the single action of pressing the clamps onto the rails;

a plurality of belt anchors mounted within the receiving surface of the frame; and an adjustable restraint assembly having a plurality of buckles configured to engage belt anchors above the shoulders of the pediatric patient and wherein the adjustable restraint assembly also extends between the legs of the pediatric patient.

6. The pediatric emergency transport device of claim 5, wherein the distance between the clamps is adjustable.

7. The pediatric emergency transport device of claim 6, wherein the restraint assembly is accessible and adjustable entirely from the top surface of the frame.

8. The pediatric emergency transport device of claim 5, wherein the belt anchors are positioned within the frame to accommodate different sized pediatric patients.

9. The pediatric emergency transport device of claim 5, wherein the frame includes an upper torso portion and a lower torso portion, the upper torso portion pivotally hinged with the lower torso portion and wherein the clamps are attached to the lower torso portion of the frame.

10. The pediatric emergency transport device of claim 5, wherein each clamp comprises a pair of opposed, pivotal, spring-loaded fingers, each pair adapted to open when the fingers initially engage a portion of one of the rails of the conventional stretcher and to close about the portion of one of the rails after receiving the portion within a groove defined therebetween.

11. The pediatric emergency transport device of claim 10, further comprising a locking assembly for locking the clamps in engagement with the rails of the conventional stretcher.

12. A pediatric emergency transport device, comprising:

(i) a frame having a top surface adapted to receive a pediatric patient thereupon and a bottom surface for resting upon a carrying surface of a conventional stretcher;

(ii) a clamp assembly mounted to the frame and adapted to engage opposed rails of the conventional stretcher by a single action of pressing the clamp assembly onto the rails, the clamp assembly remaining in clamped engagement with the rails without the use of belts;

(iii) a restraint assembly releasably attachable to the frame for restraining the pediatric patient against the top surface of the frame during transport of the pediatric patient upon the emergency transport device; and (iv) a locking assembly for locking the clamp assembly onto the opposed rails of the conventional stretcher.

13. The pediatric emergency transport device of claim 12, wherein the frame further comprises a data acquisition device coupled to the clamp assembly for measuring the weight of the pediatric patient.

14. The pediatric emergency transport device of claim 12, wherein the clamp assembly comprises clamps disposed on opposed longitudinal sides of the frame.

15. The pediatric emergency transport device of claim 14, wherein the distance between the clamps is adjustable.

16. The pediatric emergency transport device of claim 14, wherein each of the clamps further comprises:

a housing member attached to the frame; and a cam movable within the housing member, contacting a grasping device, and having applied thereto a force of a cam spring; whereby, responsively to the single action of pressing the clamp assembly onto the rails, the grasping device opens to receive a portion of the rails causing displacement of the cam within the housing member against the force of the cam spring and closes about the portion of the rails allowing a return of the cam under the force of the cam spring.

17. The pediatric emergency transport device of claim 16, wherein each grasping device comprises an opposed pair of fingers, each finger comprising:

a first segment disposed within the housing member and contacting the cam;

a second segment extended from the housing member; and a spring contacting and separating each of the first segments of the opposed pair of fingers;

wherein each finger is pivotally connected to the housing member between the first segment and the second segment, and wherein a groove for receiving the portion of the rails is defined between the second segments of the opposed fingers.

18. The pediatric emergency transport device of claim 12, wherein the restraint assembly comprises a buckle releasably attachable to any one of a plurality of belt anchors mounted to the frame in response to a single action of pressing the buckle onto one of the belt anchors.

19. The pediatric emergency transport device of claim 18, wherein the belt anchors are mounted to the frame for selective engagement with the buckle above the shoulder of the pediatric patient and wherein the belt anchors are positioned within the frame to accommodate a plurality of pediatric patient heights.

20. The device of claim 12, wherein the frame includes an upper torso portion and a lower torso portion, the upper torso portion pivotally hinged with the lower torso portion.

21. The device of claim 12, wherein the clamp assembly comprises pairs of opposed, pivotal, spring-loaded fingers, each pair adapted to open when the fingers initially engage a portion of one of the rails of the conventional stretcher and to close about the portion of one of the rails after receiving the portion within a groove defined therebetween.

22. The device of claim 12 wherein the locking assembly includes a spring-loaded locking ball that is engaged by raising the frame after the portion of one of the rails is received within the groove defined by the spring-loaded fingers.

23. The device of claim 12, wherein the clamp assembly further comprises a release button for disengaging the clamp assembly from the opposed rails.

24. The device of claim 12 wherein the restraint assembly is adjustable to accommodate the size of the pediatric patent.

25. The device of claim 12, wherein the clamp assembly is further adapted to engage opposed, parallel rails on a wall or floor of an emergency transport vehicle.

26. The device of claim 12, wherein the clamp assembly is adapted to engage the opposed rails regardless of the shape of the rails.

* * * * *

UNITED STATES PATENT AND TRADEMARK OFFICE
Certificate

Patent No. 6,898,811 B2 Patented: May 31, 2005

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Stefanie A. Zucker, Atlanta, GA (US); Suzanne J. Hantke, Loganville, GA (US); and Charles Bergh, Sherman Oaks, CA (US).

Signed and Sealed this Eighth Day of April 2008.

DAVID J. BAGNELL
*Supervisory Patent Examiner*
Art Unit 3672

UNITED STATES PATENT AND TRADEMARK OFFICE
Certificate

Patent No. 6,898,811 B2

Patented: May 31, 2005

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Stefanie A. Zucker, Atlanta, GA (US); Suzanne J. Hantke, Loganville, GA (US); Charles Bergh, Sherman Oaks, CA (US) and Lindsay W. Johnson, Glendale, AZ (US).

Signed and Sealed this Seventeenth Day of June 2014.

DAVID J. BAGNELL
*Supervisory Patent Examiner*
Art Unit 3672
Technology Center 3600